US005975670A

United States Patent [19]

Kikuta et al.

[11] Patent Number: 5,975,670

[45] **Date of Patent: *Nov. 2, 1999**

[54] RECORDING APPARATUS FOR GRADATION RECORDING

[75] Inventors: Masaya Kikuta, Tokyo; Akira Katayama, Yokohama; Hideaki Kishida, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/165,850

[22] Filed: Dec. 14, 1993

[30] Foreign Application Priority Data

Dec. 14, 1992 [JP] Japan ..... 4-332750

[51] Int. Cl.[6] ..... B41J 2/01

[52] U.S. Cl. ..... 347/15; 347/12; 395/115

[58] Field of Search ..... 347/12, 15, 180, 347/181, 131, 183, 9, 237; 395/115; 358/298

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,939,529 | 7/1990 | Kanayama et al. | 347/237 |
| 4,972,201 | 11/1990 | Katerberg et al. | 346/1.1 |
| 5,172,134 | 12/1992 | Kishida et al. | 347/13 |
| 5,245,355 | 9/1993 | Morton | 347/118 |

FOREIGN PATENT DOCUMENTS

| | | |
|---|---|---|
| 4136670 | 6/1992 | Germany . |
| 54-56847 | 5/1979 | Japan . |
| 59-123670 | 7/1984 | Japan . |
| 59-138461 | 8/1984 | Japan . |
| 60-71260 | 4/1985 | Japan . |
| 2092789 | 8/1982 | United Kingdom . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

To record a multi-valued image by an ink-jet head, an ink droplet is jetted from a recording element (nozzle) for the number of times corresponding to the density of a pixel to be reproduced. Accordingly, the pixel data to determine the number of ink-jet operation is expressed by a plurality of bits and the data of each bit are transferred to a plurality of shift registers at a time. Each shift register has storage capacity based on bit data corresponding to the number of recording elements of a recording head. When data transfer is completed, a driving signal is supplied to the recording head. The driving signals are counted and each recording element is driven based on the count result and the data stored in each register.

27 Claims, 9 Drawing Sheets

| | | | |
|---|---|---|---|
| DATA $SI_1$ | 0 | 1 | 1 |
| DATA $SI_2$ | 0 | 0 | 1 |
| | ↓ | ↓ | ↓ |
| DECODER OUTPUT WHEN COUNT VALUE = 1 | 0 | 1 | 1 |
| DECODER OUTPUT WHEN COUNT VALUE = 2 | 0 | 0 | 1 |

FIG. 8

| | | | | |
|---|---|---|---|---|
| DATA $SI_1$ | 0 | 1 | 0 | 1 |
| DATA $SI_2$ | 0 | 0 | 1 | 1 |
| | ↓ | ↓ | ↓ | ↓ |
| DECODER OUTPUT WHEN COUNT VALUE = 1 | 0 | 1 | 1 | 1 |
| DECODER OUTPUT WHEN COUNT VALUE = 2 | 0 | 0 | 1 | 1 |
| DECODER OUTPUT WHEN COUNT VALUE = 3 | 0 | 0 | 0 | 1 |

RECORDING APPARATUS FOR GRADATION RECORDING

BACKGROUND OF THE INVENTION

The present invention relates to an image recording apparatus, and more particularly, to an image recording apparatus capable of recording a visible image on a predetermined recording medium by using a recording head having a plurality of recording elements.

One of such apparatuses is an ink-jet type printer. In such a printer, the space between nozzles of the recording head has been reduced, and thus resolution of 300 dpi through 400 dpi is possible.

For example, a recording head having a length corresponding to the shorter side of an A4 paper (approximately 21 cm), so-called a full-multi-head, includes approximately 3,000 nozzles.

In this case, if all the nozzles are simultaneously driven, a large amount of electric power is required, resulting in increase in cost and size of apparatus. Therefore, the nozzles are generally divided into a plurality of groups and driven in group units.

FIG. 2 is a diagram showing an example of a full-multi-type recording head having ink-discharge ports arranged over the width (shorter side) of a recording medium. As shown in FIG. 2, electrothermal transducing elements 1 are formed on a substrate such as silicon at regular intervals by the same manufacturing process as that used in semiconductor. These elements are connected to electric wires (not shown) respectively. Partitions 14 are formed by building resin layers between the elements 1, and a fluid passageway forming member 16 in the form of a plate is adhered to the top of the partitions 14. The member 16 is further adhered to a glass plate 17, thus discharge ports 12, fluid passageways 13, and a common fluid chamber 15 are formed.

FIG. 10 is a diagram illustrating a general circuit of a drive control circuit which drives a recording head shown in FIG. 2.

In FIG. 10, $R_{1-1}$~$R_{1-n}$, $R_{2-1}$~$R_{2-n}$, . . . $R_{m-1}$~$R_{m-n}$ are electrothermal energy transducing elements (hereinafter referred to as "recording elements"). As shown in FIG. 10, n recording elements comprise a single group, and m groups of recording elements comprise a recording head.

During image recording, data expressed by bit is synchronized with a data transfer clock SCLK and transferred to shift registers 2-1~**2-*m*. The number of bits of the data is the same as that of all the recording elements. When all the data is transferred, latch circuits 1-1~1-*m* respectively latch the data stored in the shift registers 2-1~2-*m***.

Subsequently, if the first group receives a pulse signal (drive signal $BE_0$), from a CPU (not shown), whose signal level is high for a predetermined period of time, the corresponding recording elements $R_{1-1}$~$R_{1-n}$ are heated in accordance with the data held in the latch circuit 1-1. As a result, the nozzles of the heated recording elements discharge an ink-droplet.

Subsequently, the recording elements in each group are driven when the CPU (not shown) sequentially outputs drive signals $BE_1$~$BE_m$.

It is assumed that multi-valued image is recorded by discharging an ink droplet from the same nozzle for plural times. In this case, it is required that data is transferred for the number of times corresponding to the density of a pixel to be recorded. Accordingly, as the level value of an image to be reproduced increases, it takes more time to transfer data, thus resulting in decrease of recording speed.

The CPU which transfers data in particular performs an image development processing and other various processings for, e.g., a memory (not shown). Accordingly, if the above-described data transfer is frequently performed, the time divided for processings other than the data transfer is reduced. As a result, printing speed is decreased.

Furthermore, in a case where an image is recorded in three levels, a driving signal is outputted for 2×m times. Thus the load on the CPU increases.

SUMMARY OF THE INVENTION

Accordingly, it is an object of the present invention to provide a recording apparatus capable of reducing the number of data transfer processing for image recording in a case where a multi-valued image is recorded.

According to the present invention, the foregoing object is attained by a recording apparatus having a recording head including M recording elements, comprising: N shift registers, each of which has M-bit storage capacity; transfer means for transferring a first bit through N-th bit of N-bit image data respectively to a first through N-th shift register in parallel; count means for counting a driving signal with respect to the recording head after M-pixel data are transferred; and driving means for driving each recording-element of the recording head for plural times in accordance with the count result by the count means and each pixel data stored in the N shift registers.

The foregoing object is also attained by a recording apparatus having a recording head fixed in a predetermined position which includes M recording elements arranged in a direction which is substantially perpendicular to a recording medium feeding direction and across the recording medium, comprising: N shift registers, each of which has M-bit storage capacity; transfer means for transferring a first bit through N-th bit of N-bit image data respectively to a first through N-th shift register in parallel; count means for counting a driving signal with respect to the recording head after M-pixel data are transferred; and driving means for driving each recording element of recording head for plural times in accordance with the count result by count means and each pixel data stored in the N shift registers.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated and constitute a part of the specification, illustrate embodiments of the invention and, together with the description, serve to explain the principles of the invention.

FIG. 8 is a diagram for explaining another example of the operation of the decoder;

DESCRIPTION OF THE PREFERRED EMBODIMENTS

Preferred embodiments of the present invention will now be described in detail in accordance with the accompanying drawings.

Figure 1:
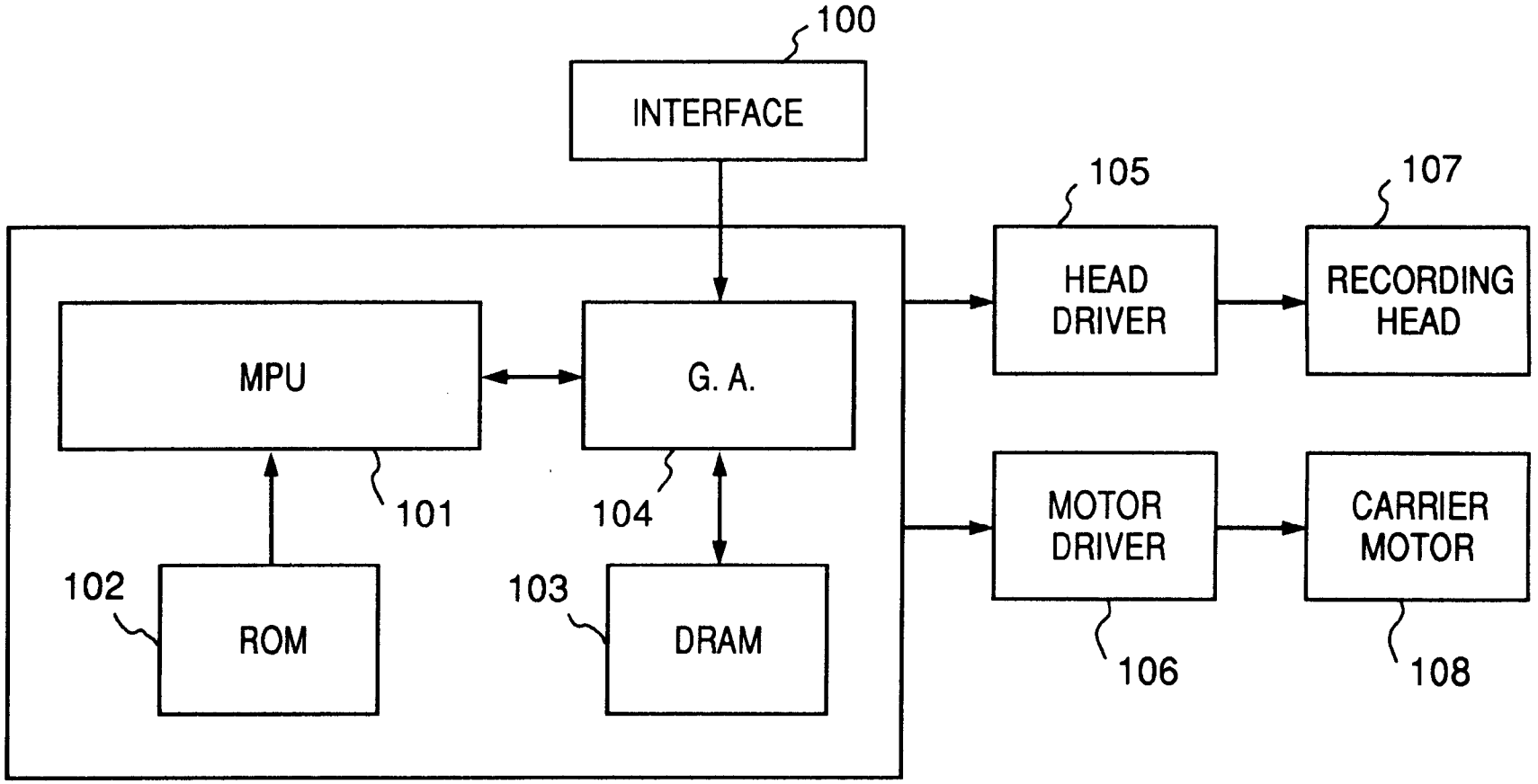
FIG. 1 is a block diagram illustrating the control structure of a recording apparatus in the embodiment.

FIG. 1 is a block diagram illustrating the construction of a recording apparatus in the embodiment. In FIG. 1, numeral 100 is an interface which inputs recording data from a host computer (not shown). Numeral 101 is a MPU which performs various controls in the recording apparatus. Numeral 102 is a ROM in which various control programs executed by the MPU has been stored. Numeral 103 is a dynamic RAM (DRAM) which stores various data (such as the above recording signal and recording data supplied to the head). Numeral 104 is a gate array (G.A. in the figure) which performs supply control of the recording data to a recording head 107. Furthermore, the gate array 104 performs data transfer control among the interface 100, MPU 101 and DRAM 103.

Numeral 105 is a head driver which drives the recording head 107, and numeral 106 is a motor driver which drives a carriage motor. The recording head 107 is an ink-jet type recording head which executes recording on a recording medium by discharging an ink-droplet. The carriage motor 108 is a motor which carries a recording medium (recording paper).

The operation of the recording apparatus having the above construction is described. First, recording data inputted from an interface 100 is converted to image data for printing by the gate array 104 and the MPU 101, and then the converted image data is supplied to the head driver 105. While the motor driver 106 is driven, the recording head 107 is driven in accordance with the image data transferred to the head driver 105.

The construction of the recording head 107 in the recording apparatus of the embodiment is similar to that of the ink-jet type recording head which is described earlier with reference to FIG. 2. That is, the recording elements of the recording head is divided into m groups and driven in each group. The ink-jet type recording head of the present embodiment is a so-called full-multi-type recording head in a form where ink-discharging ports are arranged over the range corresponding to the width (shorter side) of a recording medium, and records an image in three levels (no ink-droplet discharge, one ink-droplet discharge and two ink-droplet discharges).

Figure 2:
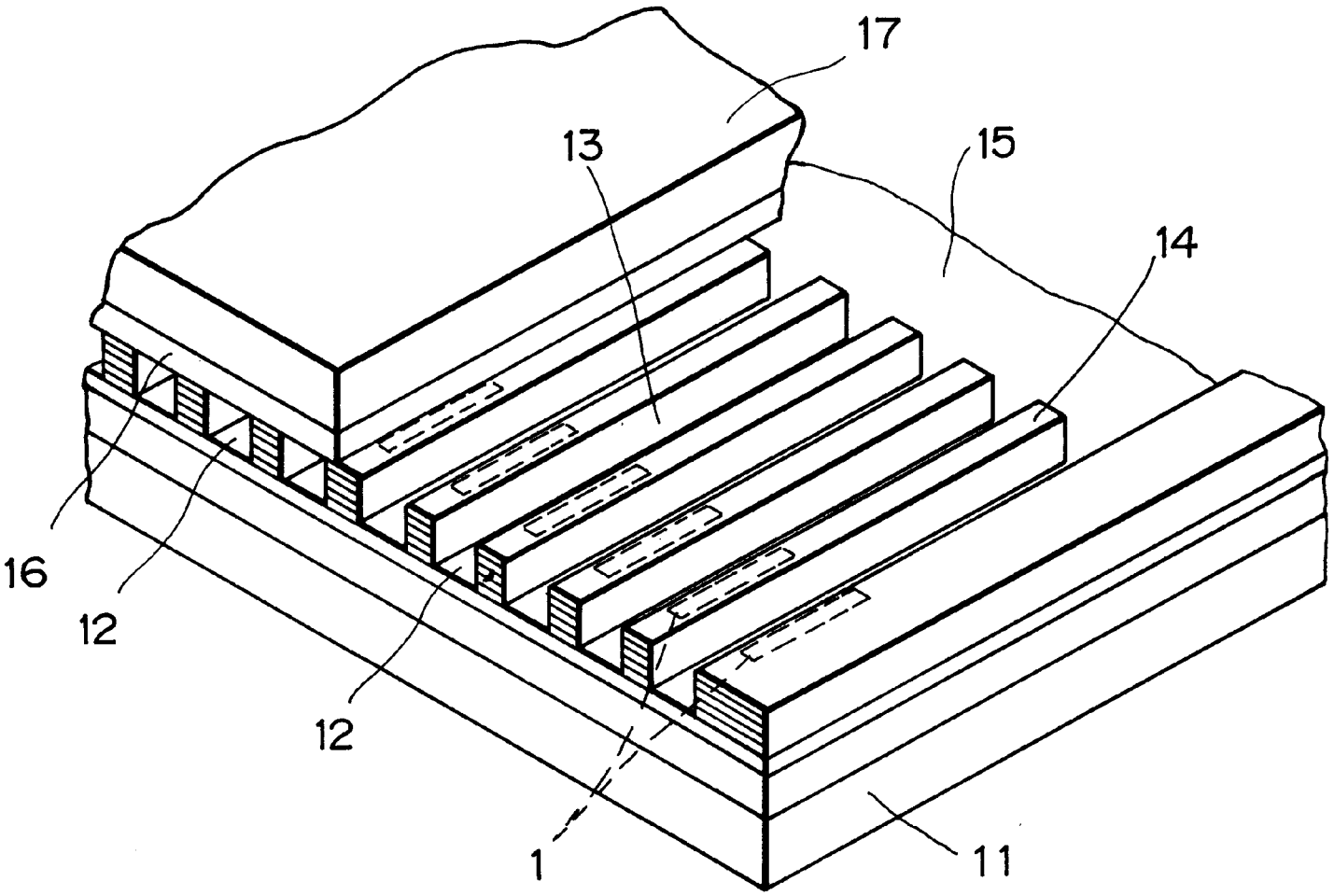
FIG. 2 is a diagram illustrating the construction of an ink-jet type recording head of the recording apparatus of the embodiment.
Figure 3:
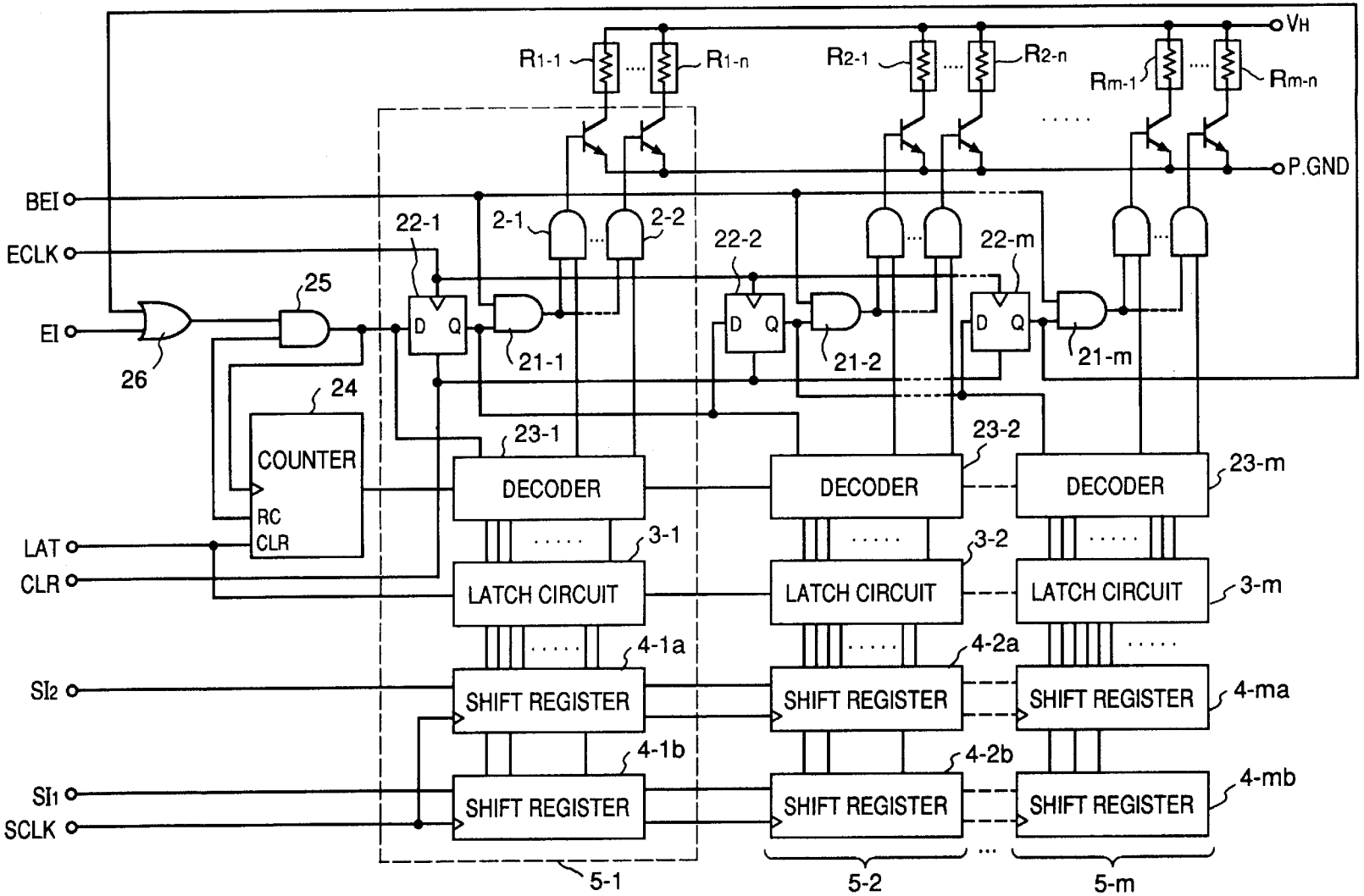
FIG. 3 is a diagram illustrating the circuit structure of a head driver.

FIG. 3 is a diagram illustrating the circuit construction of the head driver 105 which drives an ink-jet type recording head having a mechanical construction shown in FIG. 2. In the embodiment, the head driver 105 is comprised of a single board.

In FIG. 3, $SI_1$ and $SI_2$ are two-bit recording data signals of a line which are recorded in three levels, and are supplied in parallel. In this embodiment, a three-level image is recorded by those signals (to be described later with reference to FIG. 7). The recording data inputted by signal lines of the signals $SI_1$ and $SI_2$ are synchronized with data transfer clock SCLK and respectively stored in shift registers 4-*ia* and 4-*ib* (i=1~*m*) in each of the drive circuits 5-1~5-*m*. When data transfer required for recording is completed, latch circuits 3-1~3-*m* hold bit data stored in the shift registers 4-*ia* and 4-*ib* by a LAT signal.

OR gate 26 outputs a logical OR of a driving signal EI (an external driving signal) supplied from outside (a controller) and a driving signal (an internal driving signal), which circulates internally, from the m-th driving circuit 5-*m*. Numeral 24 is a counter which counts the number of loops of external driving signals EI or the internal driving signal (the number of times of recording execution). Subsequently, the count value is outputted to the decoders 23-1~23-*m*, respectively. Furthermore, an AND gate 25 suspends the internal driving signal when a predetermined number of data is counted by the counter 24. Accordingly, the counter 24 and AND gate 25 repeatedly generate driving signals for a predetermined value set in the counter 24 for the driving circuit 5-1. The decoders 23-1~23-*m* respectively select data to be recorded from the data held in the latch circuits 3-1~3-*m* based on the value set in the counter 24. Considering the decoder 23-1, either data from the shift register 4-1*a* or that from 4-1*b* is selected and outputted. The above processing is also performed in the other driving circuits 5-2~5-*m*.

The flip flop 22-1 sets the internal driving signals outputted from the AND gate 25 by synchronizing with the transfer clocks ECLK. Accordingly, electric current flows only to the recording elements selected by output data of the decoder 23 while a current-flow set-signal (BEI) is activated by the AND gate 21-1 and AND gate 2-1~2-*n*. The above processing is also performed in the other driving circuits 5-2~5-*m*.

Figure 4:
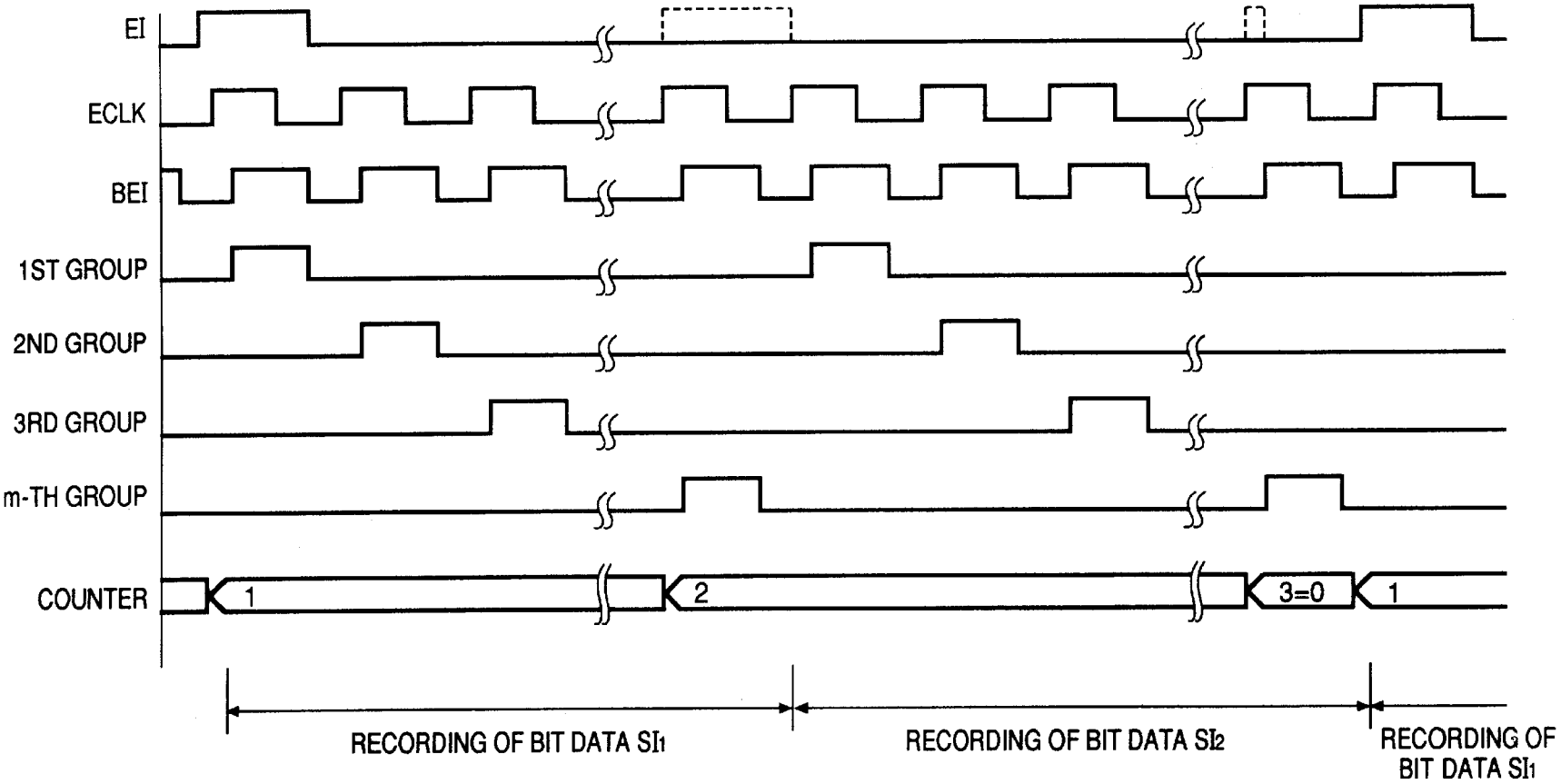
FIG. 4 is a timing chart showing the operation timing in the circuit of FIG. 3.

The operation of the head driver 105 with the above circuit structure is explained with reference to the timing chart of FIG. 4. When data transfer of bit data $SI_1$ and $SI_2$ are completed, an external driving signal EI is supplied from outside after a latch signal is supplied to all the latch circuits 3-1~3-*m* for holding the transferred data. The external driving signal EI is sequentially supplied to each group via the flip-flops 22-1~22-*m* by synchronizing with the driving signal transfer clock ECLK and delaying one clock of the clock ECLK. Furthermore, the decoder 23-*i* switches a selection output at the timing where an output Q of the previous flip-flop 23-*j* (j=i-1) is set in accordance with the count value from the counter 24. Subsequently, an electric current flows to the recording elements selected by the output of the decoder 23-*i* while the signal BEI is set in a group where the output from the flip-flop 22-*i* is set.

As described above, the bit data $SI_1$ is sequentially recorded. When the output Q of the flip-flop 22-*m* in the m-th group is set by ECLK, the m-th group is activated and the output Q of the flip-flop 22-*m* in the m-th group is supplied to the OR gate 26 as an internal driving signal to record next data $SI_2$. In FIG. 4, the timing for generating the internal driving signal is represented by a dot line on the external signal EI. By the internal driving signal, the counter 24 is updated so that each decoder 23 selects bit data $SI_2$. The bit data $SI_2$ is recorded in the way similar to the data $SI_1$. Furthermore, when the final m-th group is activated in the recording of the bit data $SI_2$, a driving signal is generated by the output Q of the flip-flop 22-*m* in the m-th group. Accordingly, since the count value of the counter 24 becomes "3" and a signal from the terminal RC is outputted, the counter 24 is reset, and thus the signal is not transmitted to the first group as an internal driving signal.

As described above, the bit data $SI_1$ and $SI_2$ are sequentially recorded by input of a single external driving signal EI. While the bit data is being recorded, the bit data $SI_1$ and $SI_2$ for the next line are respectively transferred to the shift registers 4-1*a* and 4-1*b*.

The ink-jet interval of each group of the recording elements can be constant between the time for the completion of recording of bit data $SI_2$ of the m-th group and the time for the rise of the next ECLK.

Figure 5A:
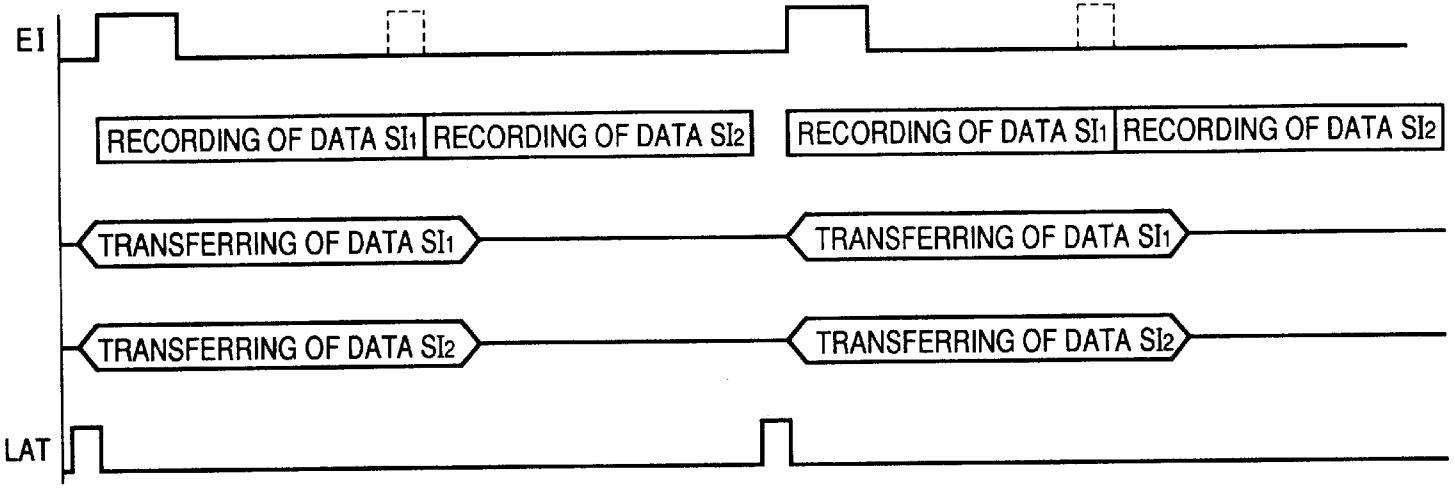
FIG. 5A is a timing chart showing a timing of data recording and data transferring in the embodiment.
Figure 5B:
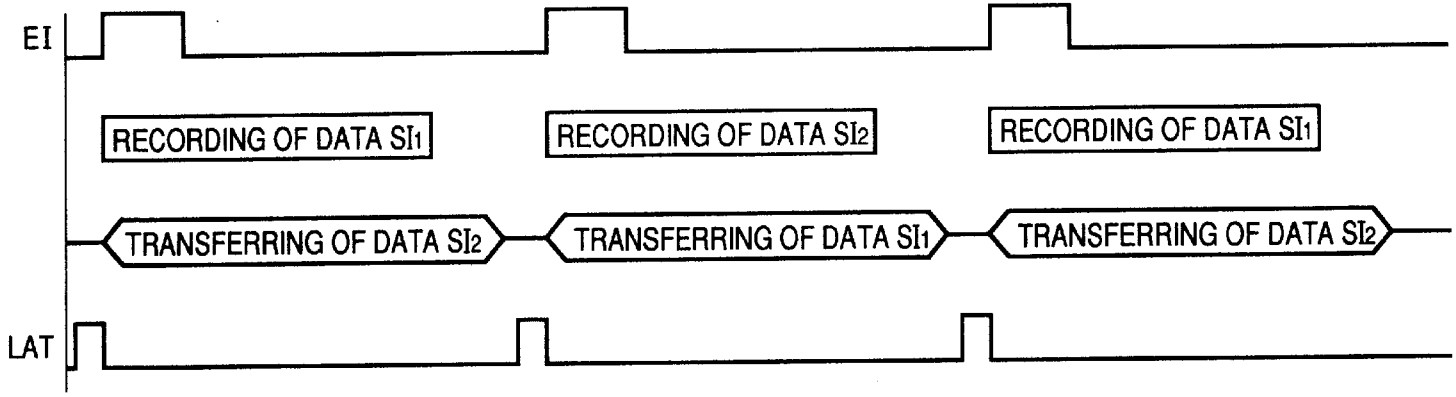
FIG. 5B (PRIOR ART)
FIG. 5B is a timing chart showing a timing of data recording and data transferring in the conventional technique.

FIG. 5A is a timing chart showing the timing of data recording and data transferring in the present embodiment, and FIG. 5B is a timing chart showing the time of data recording and data transferring in the conventional technique. As apparent from these charts, in the present technique, two bit data ($SI_1$ and $SI_2$) are simultaneously transferred, and the time for recording these data is reduced in comparison with that of the conventional technique. Furthermore, since the number of occurrence of the latch signal LAT and driving signal EI is decreased, the load on the controller such as a CPU is reduced.

Figures 6, 7:
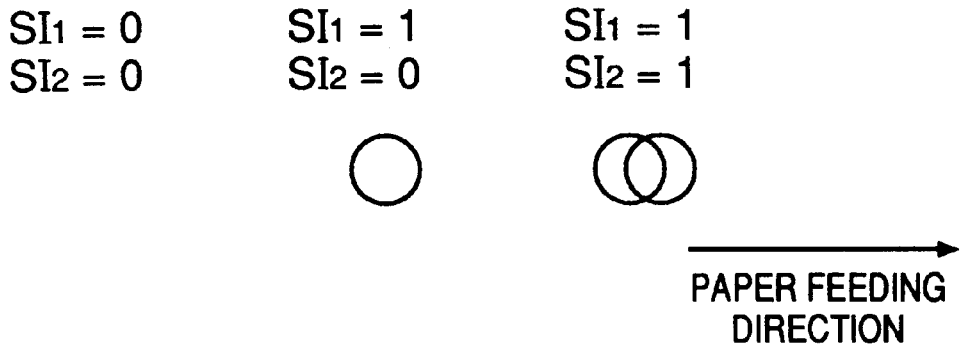
FIG. 6 is a diagram for explaining the operation of a decoder of the embodiment.
FIG. 7 is a diagram showing the recording state of multi-valued data in the embodiment.

FIG. 6 shows the processing of the decoder in the present embodiment. Here, contents of data to be outputted is determined in accordance with the data held in the latch circuit 3 and the count value of the counter 24. More particularly, when a count value of the counter 24 is "1", data $SI_1$ is outputted, while when a value is "2", data $SI_2$ is outputted.

FIG. 7 is a diagram illustrating the recording state of multi-valued data. The shift of a recording dot in the lateral direction as shown in FIG. 7 is caused by paper feeding operation.

As described above, according to the recording apparatus of the embodiment, ternary data can be transferred at a time. Furthermore, by setting a count value in the counter 24 to "3", it is possible to record three-level image only by supplying a single driving signal.

Accordingly, the time for transferring data from the controller can be reduced by the internal driving signal generator in an ink-jet recording head and the circuit structure such that data expressed by plural bits is inputted in parallel and decoded. As a result, the recording speed as a whole system is improved. Furthermore, a driving frequency in each group and a paper feeding speed can be at a predetermined level regardless of a maximum density value of a line to be recorded, thus resulting in simplification of the control.

In the above embodiment, the recording of ternary (three-level) data is performed for two-bit input data, however, this does not impose a limitation upon the invention. For example, if four-level data is recorded for three-bit input data, three signal lines may be provided, the counter 24 is set to "4" and the decoder 23 is changed to correspond to this setting. Furthermore, four-level data can be recorded by using two-bit input data as binary data. In this case, an output of the decoder 23 is as shown in FIG. 8. That is, the count value of the counter 24 is compared with a density value (0~3) represented by $SI_1$ and $SI_2$ and, if the density is high, an ink droplet is discharged.

Figure 9:
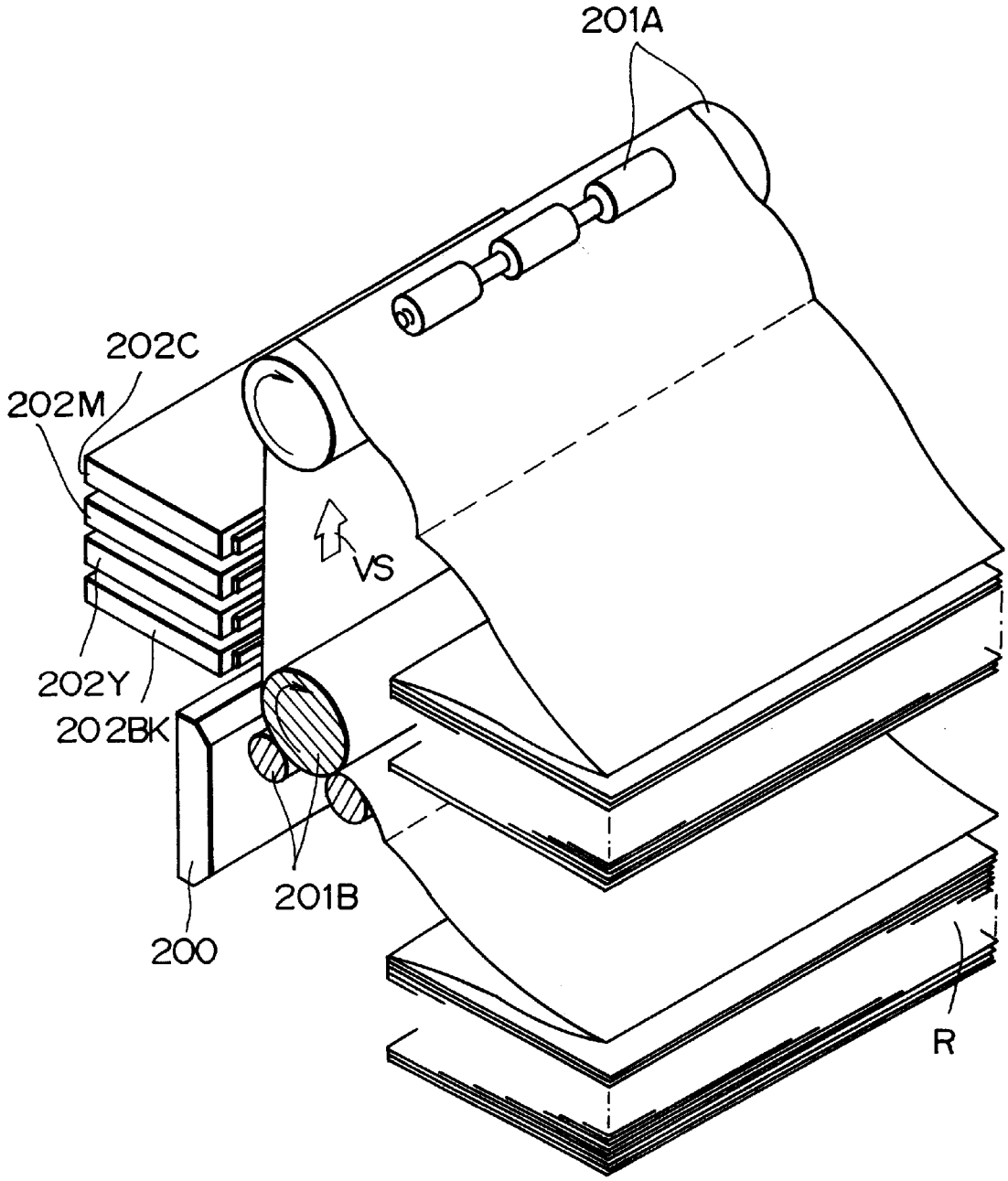
FIG. 9 is a diagram for explaining the construction of a recording unit of the recording apparatus capable of full-color recording.
Figure 10:
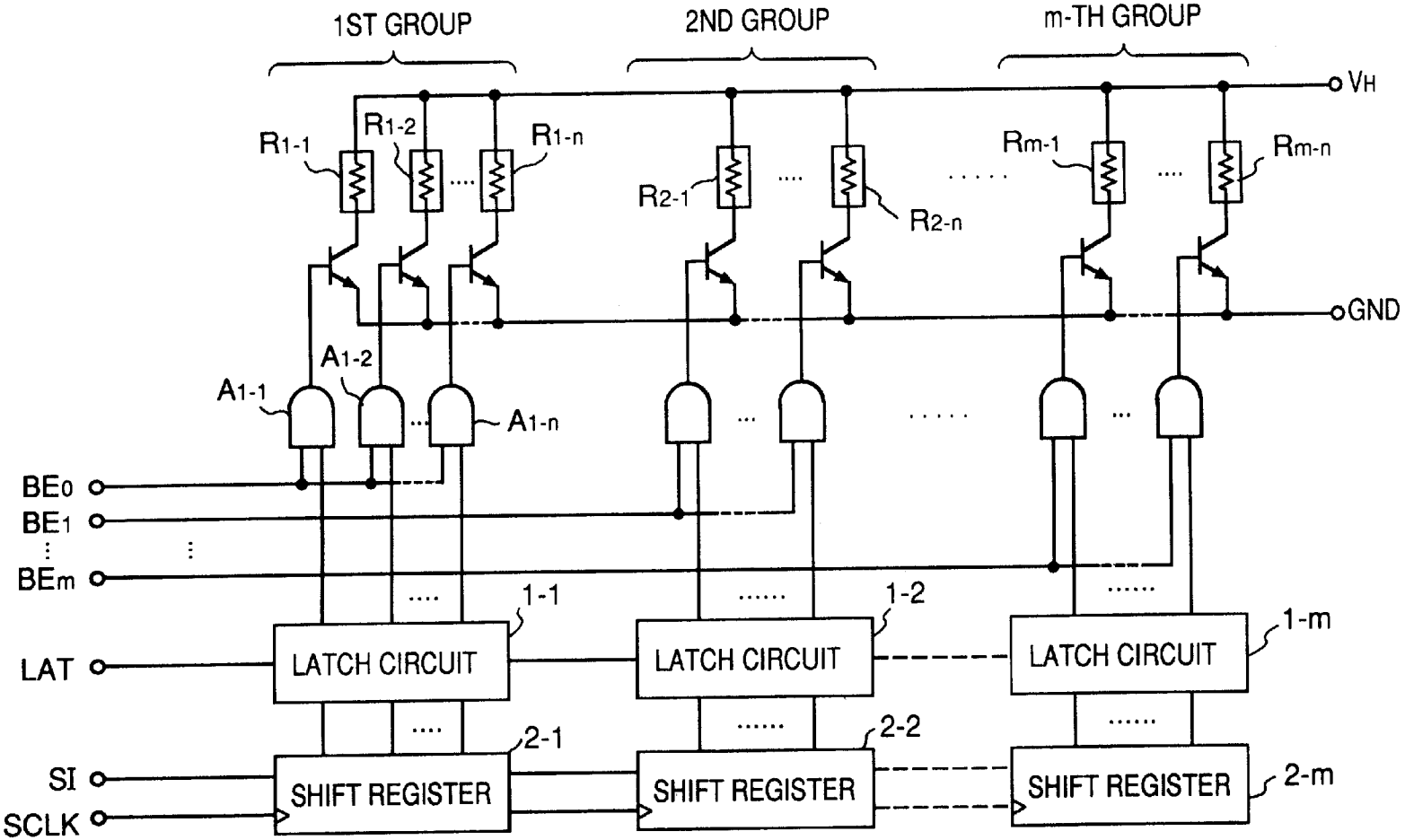
FIG. 10 (PRIOR ART)
FIG. 10 is a diagram illustrating the circuit structure of the conventional head driver.

Furthermore, a line printer capable of full-color recording as shown in FIG. 9 can be provided by using the above-described recording head and the driving control circuit. In FIG. 9, numerals 201A and 201B are respectively a pair of rollers to carry the recording medium R in the sub-scanning direction. Numerals 202BK, 202Y, 202M and 202C comprise a full-multi-type recording head which records black, yellow, magenta and cyan by arranging the nozzles over the width (shorter side) of the recording medium R. The nozzles are sequentially arranged in the above order from the upper stream in the paper feeding direction VS. Numeral 200 is a recovery system which faces the recording head 202BK~202C instead of the recording medium R during the ink-jet recovery processing. In this line printer capable of full-color recording, the recording head of each color can be applied to the circuit shown in FIG. 3 and the same result can be obtained.

Furthermore, if a two-level recording is performed, only the data $SI_1$ is transferred or the value of the counter 24 is set to "2".

The present invention provides (excellent) effects especially in a printing apparatus having an ink-jet recording head of the type in which printing is performed by forming flying droplets utilizing thermal energy.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatus. In particular, in the case of the on-demand type, at least one drive signal, which provides a sudden temperature rise that exceeds that for film boiling, is applied, in accordance with print information, to an electrothermal transducer arranged to correspond to a sheet or fluid passageway holding a fluid (ink). As a result, thermal energy is produced in the electrothermal transducer to bring about film boiling on the thermal working surface of the recording head. Accordingly, air bubbles can be formed in the fluid (ink) in one-to-one correspondence with the drive signals. A discharging port is made to discharge the fluid (ink) by growth and contraction of the air bubbles so as to form at least one droplet. If the drive signal has the form of a pulse, growth and contraction of the air bubbles can be made to take place rapidly and in appropriate fashion. This is preferred since it will be possible to achieve fluid (ink) discharging having excellent response.

Signals described in the specifications of U.S. Pat. Nos. 4,463,359 and 4,345,262 are suitable as drive pulses having this pulse shape. It should be noted that even better printing can be performed by employing the conditions described in the specification of U.S. Pat. No. 4,313,124, which discloses an invention relating to the rate of increase in the temperature of the above-mentioned thermal working surface. In addition to the combination of the discharging port, fluid passageway and electrothermal transducer (in which the fluid passageway is linear or right-angled) disclosed as the construction of the recording head in each of the above-mentioned specifications, the present invention covers also an arrangement using the art described in the specifications of U.S. Pat. Nos. 4,558,333 and 4,459,600, which disclose elements disposed in an area in which the thermal working portion is curved.

Further, it is permissible to adopt an arrangement based upon Japanese Patent Application Laid-Open No. 59-123670, which discloses a configuration having a common slot for the discharging portions of a plurality of electrothermal transducers, or Japanese Patent Application Laid-Open No. 59-138461, which discloses a configuration having openings made to correspond to the discharging portions, wherein the openings absorb pressure waves of thermal energy.

It is permissible to use a freely exchangeable tip-type recording head attached to the main body of the apparatus and capable of being electrically connected to the main body of the apparatus and of supplying ink from the main body, or a cartridge-type recording head in which an ink tank is integrally provided on the recording head itself.

The addition of recovery means for the recording head and spare auxiliary means provided as components of the printing apparatus of the invention is desirable since these stabilize the effects of the invention greatly. Specific examples of these means that can be mentioned are capping means for capping the recording head, cleaning means, pressurizing or suction means, and preheating means such as an electrothermal transducer or another heating element or a combination thereof. Implementing a preliminary discharging mode for performing discharging separately of recording also is effective in order to perform stabilized printing.

The printing mode of the printing apparatus is not limited merely to a printing mode for a mainstream color only, such as the color black. The recording head can have a unitary construction or a plurality of recording heads can be combined. The apparatus can be one having at least one recording mode for a plurality of different colors or for full-color recording using mixed colors.

Further, ink is described as being the fluid in the embodiments of the invention set forth above. The ink used may be one which solidifies at room temperature or lower, or one which liquefies at room temperature. Alternatively, in an ink-jet arrangement, generally the ink is temperature-controlled by regulating the temperature of the ink itself within a temperature range of between 30° C. and 70° C. so that the viscosity of the ink will reside in a region that allows stable discharging of the ink. Therefore, it is permissible to use an ink which liquefies when the printing signal is applied.

In order to positively prevent elevate temperature due to thermal energy when this is used as the energy for converting the ink from the solid state to the liquid state, or in order to prevent evaporation of the ink, it is permissible to use an ink which solidifies when left standing. In any case, the present invention is applicable also in a case where use is made of an ink which solidifies in response to application of thermal energy, such as an ink solidified by application of thermal energy conforming to a printing signal or ink which has already begun to solidify at the moment it reaches the recording medium. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

Furthermore, as to the form of the printing apparatus according to the present invention, use is not limited to an image output terminal of an image processing apparatus such as a word processor or computer described above. Other configurations, which may be provided as a separate or integral part, include a copying machine in combination with a reader or the like, a facsimile machine having a transmitting/receiving function, etc.

In accordance with the other embodiment of the invention as described above, the density of one band of an image is judged and a changeover is made between the single scanning mode in which the entire image of one line is printed by a specific nozzle and the sequential multi-scanning mode in which ink is discharged using a plurality of nozzles, whereby a full-color image in which unevenness is conspicuous even in one page of the original is printed in the sequential multi-scanning mode. When a portion having high density, such as a character portion, is printed, unevenness in the density of the printed image is rendered inconspicuous, even when the image is printed in the single scanning mode. Printing speed is not reduced too much, the copying apparatus is easy to use and the copying apparatus employs a multi-nozzle head.

The present invention can be applied to a system constituted by a plurality of devices or to an apparatus comprising a single device. Furthermore, it goes without saying that the invention is applicable also to a case where the object of the invention is attained by supplying a program to a system or apparatus.

According to the recording apparatus of the invention, since multi-valued data for recording a line are inputted in parallel, a processing speed is increased.

Furthermore, according to the recording apparatus of the present invention, when recording is performed based on the bit data of a line inputted in parallel, a driving signal to record bit data after the second time is automatically generated, thus the load on the controller is reduced.

As many apparently widely different embodiments of the present invention can be made without departing from the spirit and scope thereof, it is to be understood that the invention is not limited to the specific embodiments thereof except as defined in the appended claims.

What is claimed is:

1. A recording apparatus having a recording head including a plurality of recording elements of a number, M is a positive integer, comprising:

N memory means (N, is a positive integer equal to or larger than 2), each of which has M-bit storage capacity;

transfer means for transferring M-bit data to respective said N memory means so that respective time periods for transferring M-bit data to said N memory means are overlapped with each other;

output means for sequentially selecting M-bit data stored in each of said N memory means, and outputting the selected M-bit data; and driving means for driving M recording elements of said recording head for N times in accordance with M-bit data outputted by said output means, wherein an image having a gradation of N+1 is recorded by driving said recording head for N times and in accordance with M-bit data sequentially outputted by said output means.

2. The recording apparatus according to claim 1, further comprising:

count means for counting a driving of said driving head;

latch means for holding N×M-bit data stored in said N memory means, and wherein said driving means energizes or deenergizes an i-th ($1 \leqq i \leqq M$) said recording element in accordance with N-bit data with respect to an i-th pixel held by said latch means and a count value counted by said count means.

3. The recording apparatus according to claim 1, wherein the recording head is divided into a plurality of groups of a number P (P is a positive integer), each of which said groups is composed of a plurality of recording elements.

4. The recording apparatus according to claim 3, wherein said driving means comprises:

a plurality of delay circuits of said number P, which said delay circuits are connected to form a loop;

driving signal supply means for supplying the driving signal to a first said delay circuit; and signal supply means for supplying a signal outputted from an i-th ($1 \leqq i \leqq P$) said delay circuit as a driving signal for a j-th ($1 \leqq j \leqq P$) said group, and wherein said count means counts said driving signals supplied to the first said delay circuit.

5. The recording apparatus according to claim 4, wherein said count means is reset in a case where a count value reaches a level of a level image to be recorded.

6. The recording apparatus according to claim 4, wherein said driving means drives said recording head to record an N+1-level image by selecting one of said N memory means in accordance with a result of said count means.

7. The recording apparatus according to claim 4, wherein said driving means further comprises comparison means for comparing the count result of said count means and a value of a pixel data expressed by N bits, and wherein a particular said recording element is driven in accordance with the comparison result by said comparison means in order to record an image having a $2^N$-level image.

8. The recording apparatus according to claim 1, wherein said recording head is an ink-jet type recording head.

9. The recording apparatus according to claim 1, wherein said recording head is an ink-jet type head which discharges a plurality of ink droplets by utilizing thermal energy, and each said recording element is provided with a thermal energy generating element to generate thermal energy applied to an ink.

10. A recording apparatus which records an image having a gradation of N+1, N is a positive integer equal to or larger than 2, by driving a recording head, fixed in a predetermined position which includes a plurality of recording elements of a number M, M is a positive integer, arranged in a direction, which is substantially perpendicular to a recording medium feeding direction and across the recording medium, comprising:

N memory means, each of which has M-bit storage capacity;

transfer means for transferring M-bit data to respective said N memory means so that respective time periods for transferring M-bit data to said N memory means are overlapped with each other;

output means for sequentially selecting M-bit data stored in each of said N memory means, and outputting the selected M-bit data; and driving means for driving said M recording elements of said recording head for N times in accordance with the M-bit data outputted by said output means, wherein an image having the gradation of N+1 is recorded by driving said recording head for N times and in accordance with M-bit data sequentially outputted by said output means.

11. The recording apparatus according to claim 10, further comprising:

count means for counting a driving of said recording head;

latch means for holding N×M-bit data stored in said N memory means, and wherein said driving means energizes or deenergizes an i-th ($1 \leqq i \leqq M$) said recording element in accordance with N-bit data with respect to an i-th pixel held by said latch means and a count value counted by said count means.

12. The recording apparatus according to claim 10, wherein the recording head is divided into a plurality of groups of a number P (P is a positive integer), each of which said groups is composed of a plurality of recording elements.

13. The recording apparatus according to claim 12, wherein said driving means comprises:

a plurality of delay circuits of said number P, which said delay circuits are connected to form a loop;

driving signal supply means for supplying the driving signal to a first said delay circuit; and signal supply means for supplying a signal outputted from an i-th ($1 \leqq i \leqq P$) said delay circuit as a driving signal for a j-th ($1 \leqq j \leqq P$) said group, and wherein said count means counts said driving signals supplied to the first said delay circuit.

14. The recording apparatus according to claim 12, wherein said count means is reset in a case where a count value reaches a level of a level image to be recorded.

15. The recording apparatus according to claim 12, wherein said driving means drives said recording head to record an N+1-level image by selecting one of said N memory means in accordance with a result of said count means.

16. The recording apparatus according to claim 12, wherein said driving means further comprises comparison means for comparing the count result of said count means and a value of a pixel data expressed by N bits, and a particular said recording element is driven in accordance with the comparison result by said comparison means in order to record an image having a $2^N$-level image.

17. The recording apparatus according to claim 10, wherein said recording head is an ink-jet type recording head.

18. The recording apparatus according to claim 10, wherein said recording head is an ink-jet type head which discharges a plurality of ink droplets by utilizing thermal energy, and each said recording element is provided with a thermal energy generating element to generate thermal energy applied to an ink.

19. A recording apparatus comprising:

a recording head including a plurality of recording elements;

a plurality of shift registers of a number N, N being a positive integers being greater than 2;

transfer means for transferring data to each of said N shift registers; and driving means for driving said recording elements of said recording head in accordance with data stored in said shift registers, wherein said plurality of shift registers are arranged to receive a plurality of N sequences of M-bit data in parallels, M being a positive integer;

said recording apparatus further comprising:

counter means for counting the numbers of times said recording head is driven based on bit data stored in said shift registers; and selecting means for sequentially selecting bit data stored in respective ones of said shift registers in accordance with the count result by said counter means and for outputting, in parallel, the selected bit data;

whereby a multi-value image is recorded by driving said recording head for the number of times corresponding to the density of a pixel to be reproduced and in accordance with the bit data selected by said selecting means.

20. A recording apparatus according to claim 19, further comprising latch means for holding N×M bit data stored in said shift registers;

wherein said driving means energizes recording elements in accordance with the output of said selecting means.

21. A recording apparatus according to claim 20, wherein said recording head is divided into a plurality of groups of a number P being a positive integer; and each of said groups is composed of a plurality of recording elements.

22. A recording apparatus according to claim 21, wherein said driving means comprises:

P delay circuits being connected to form a loop;

driving signal supply means for supplying the driving signal to the first of said delay circuits; and signal supply means for supplying a signal outputted from an i-th ($1 \leqq i \leqq P$) of said delay circuits as a driving signal for the j-th ($1 \leqq j \leqq P$) of said groups; wherein said counter means is adapted to count said driving signals supplied to said first delay circuit.

23. A recording apparatus according to claim 22, wherein said counter means is adapted to be reset when the count value reaches a present level corresponding to a gradation level of the image to be recorded.

24. A recording apparatus according to claim 22, wherein said driving means is adapted to drive said recording head to record an N+1-level image by sequentially selecting respective ones of said plurality of shift registers in accordance with the result of said counter means.

25. A recording apparatus according to claim 22, wherein said driving means further comprises:

comparison means for comparing the count result of said counter means and a value of a pixel data expressed by N bits; and a particular recording element is driven in accordance with the comparison result by said comparison means in order to record an image having an N-level image.

26. A recording apparatus according to claim 19, wherein said recording head is an ink-jet type head which discharges a plurality of ink droplets by utilizing thermal energy, and each of said recording elements is provided with a thermal energy generating element to generate thermal energy applied to ink.

27. A recording apparatus according to claim 19, wherein said recording head is fixed at a predetermined position and has its plurality of recording elements arranged in a direction which is substantially perpendicular to a recording medium feeding direction and across said recording medium.

* * * * *

UNITED STATES PATENT AND TRADEMARK OFFICE

CERTIFICATE OF CORRECTION

PATENT NO. : 5,975,670

DATED : November 2, 1999

INVENTOR(S) : MASAYA KIKUTA ET AL.

It is certified that error appears in the above-identified patent and that said Letters Patent is hereby corrected as shown below:

COLUMN 7

Line 35, "elevate" should read --elevated--.

COLUMN 8

Line 30, "number, M" should read --number M,M--;
Line 32, "means (N," should read --means, N--;
Line 34, "2)," should read --2,-- and
"which" should read --said memory means--.

COLUMN 10

Line 45, "2;" should read --1;--; and
Line 53, "parallels," should read --parallel,--.

Signed and Sealed this

Third Day of April, 2001

Nicholas P. Godici

*Attest:*

NICHOLAS P. GODICI

*Attesting Officer*

*Acting Director of the United States Patent and Trademark Office*